US009442450B2

(12) United States Patent
Sato et al.

(10) Patent No.: US 9,442,450 B2
(45) Date of Patent: Sep. 13, 2016

(54) SHEET CONVEYING APPARATUS AND IMAGE FORMING APPARATUS

(71) Applicant: CANON KABUSHIKI KAISHA, Tokyo (JP)

(72) Inventors: Kengo Sato, Koshigaya (JP); Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/874,667

(22) Filed: Oct. 5, 2015

(65) Prior Publication Data

US 2016/0103412 A1 Apr. 14, 2016

(30) Foreign Application Priority Data

Oct. 9, 2014 (JP) ..... 2014-208311

(51) Int. Cl.

| | |
|---|---|
| ***G03G 15/00*** | (2006.01) |
| ***G03G 21/00*** | (2006.01) |
| ***B65H 29/00*** | (2006.01) |
| ***B65H 29/70*** | (2006.01) |
| ***B65H 23/34*** | (2006.01) |
| ***B65H 5/06*** | (2006.01) |
| ***B65H 27/00*** | (2006.01) |

(52) U.S. Cl.

CPC ..... *G03G 15/6576* (2013.01); *B65H 5/062* (2013.01); *B65H 27/00* (2013.01)

(58) Field of Classification Search

CPC ..... G03G 15/00; G03G 21/00; B65H 29/00; B65H 23/34

USPC ..... 399/406

See application file for complete search history.

(56) References Cited

U.S. PATENT DOCUMENTS

| | | | | |
|---|---|---|---|---|
| 5,091,754 | A | 2/1992 | Abe et al. | |
| 5,154,411 | A | 10/1992 | Saito et al. | |
| 5,172,138 | A | 12/1992 | Okazawa et al. | |
| 5,287,157 | A | 2/1994 | Miyazato et al. | |
| 5,481,336 | A | 1/1996 | Tachibana et al. | |
| 5,737,681 | A * | 4/1998 | Hyakutake | G03G 15/1695 399/388 |
| 5,787,331 | A * | 7/1998 | Ohkuma | B41J 3/60 162/271 |
| 5,812,923 | A * | 9/1998 | Yamauchi | G03G 15/167 399/388 |
| 6,487,379 | B2 | 11/2002 | Sato | |
| 6,496,660 | B2 | 12/2002 | Takahashi et al. | |
| 6,581,922 | B2 | 6/2003 | Kuwata et al. | |
| 6,674,976 | B2 | 1/2004 | Sato et al. | |
| 6,687,484 | B2 * | 2/2004 | Oikawa | B65H 39/10 271/188 |
| 6,785,478 | B2 | 8/2004 | Takahashi et al. | |
| 2011/0229178 | A1 * | 9/2011 | Ogawa | G03G 15/6576 399/67 |

FOREIGN PATENT DOCUMENTS

| | | |
|---|---|---|
| JP | 09-30712 A | 2/1997 |
| JP | 2002-93475 A | 3/2002 |

OTHER PUBLICATIONS

GB Search Report issued in corresponding GB Application No. 1517827.0 dated Mar. 1, 2016.

* cited by examiner

*Primary Examiner* — Nguyen Ha

(74) *Attorney, Agent, or Firm* — Fitzpatrick, Cella, Harper & Scinto

(57) ABSTRACT

A sheet conveying apparatus is provided with a driving portion, and the driving portion is normally rotated, driving power from the driving portion is transmitted to a cam member through a transmitting portion. Then, one of a rotary roller pair is moved to another one. The sheet conveying apparatus further includes a restricting portion that restricts the cam member from turning in a direction opposite to a turning direction turned in response to a normal rotation of the driving portion.

18 Claims, 12 Drawing Sheets

SHEET CONVEYING APPARATUS AND IMAGE FORMING APPARATUS

BACKGROUND OF THE INVENTION

1. Field of the Invention

The present invention relates to a sheet conveying apparatus conveying a sheet and to an image forming apparatus.

2. Description of the Related Art

Hitherto, an image forming apparatus electro-photographically forming an image transfers a toner image formed in an image forming portion to a sheet fed from a sheet feed portion, guides the sheet to a fixing apparatus, and fixes an unfixed toner on the sheet onto the sheet. It is noted that such image forming apparatus includes what is connected with a sheet processing apparatus to conduct such processes as sorting, stapling, punching, and others on the sheet on which the image has been formed.

By the way, there is a case when the sheet curls (deforms) in fixing the toner image onto the sheet by applying heat and pressure by the fixing apparatus. If the sheet curls, the curled sheet may cause jamming or affect precision of performance of such processes as stacking and alignment. Therefore, it is necessary to correct the curl of the sheet in order to improve quality of the processed sheet.

Then, there is a sheet conveying apparatus conveying a sheet on which a toner image has been fixed to a sheet processing apparatus and is provided with a curl correcting apparatus reversely curling the curled sheet. Some of such curl correcting apparatus includes a first curl correcting portion correcting a curl convexed (projecting upward) with respect to a conveying direction for example and a second curl correcting portion correcting a curl concaved (projecting downward) with respect to the conveying direction. Then, the curl correcting apparatus corrects the curl of the sheet by using at least one of the first and second curl correcting portions corresponding to the directions of the curl.

It is noted that the curl of the sheet occurs because of toner transferred onto the sheet that melts by being heated by the fixing apparatus and then condenses as it is cooled down. Still further, magnitude of the curl varies depending on types of the sheet, temperature and humidity, image density and others. Therefore, in correcting the curl by the curl correcting apparatus, a curl correcting amount to be corrected by the first and second curl correcting portions is determined based on the temperature and humidity, the moisture content of the sheet, the type of the sheet, the thickness of the sheet, the image density, and others.

Normally, each curl correcting portion of the curl correcting apparatus includes a hard roller conveying the sheet and a soft roller in pressure contact with the hard roller. Then, a curved nip portion is formed by causing the hard roller to bite into the soft roller in bringing the soft roller into pressure contact with the hard roller, and the curl is corrected by passing the curled sheet through the curved nip portion.

Here, as disclosed in Japanese Patent Application Laid-open No. Hei. 9-30712, it is possible to adjust the curl correcting amount by changing a pressing force applied to the soft roller to change a bite amount (intrusion amount) of the hard roller into the soft roller. In order to change the bite amount (intrusion amount) as describe above, there is proposed one in which position of one roller is changed by using a motor and a cam member for example.

By the way, one set each of the motor and the cam member is required to independently adjust the curl correcting amount in the first and second curl correcting portions.

However, it is preferable to minimize a number of the actuators such as the motors from an aspect of cutting electric power, saving a space, and cutting a cost. To that that, Japanese Patent Application Laid-open No. 2002-93475 proposes a configuration in which the first and second curl correcting portions are independently driven by normal and reverse rotations of a motor by using one normally and reversely rotatable motor and a clutch mechanism, such as a clutch, transmitting a rotational force only in one direction.

Then, in the case of this configuration, driving power of the motor is transmitted to the first curl correcting portion through the clutch mechanism in response to a normal rotation of the motor, and the driving power is transmitted to the second curl correcting portion through the clutch mechanism in response to a reverse rotation of the motor.

By the way, it is essential to be able to control positions of the cam member accurately because the intrusion amount (pressing force) of the roller is adjusted in a plurality of stages for the various parameters such as the temperature and humidity, the moisture content of the sheet, the type of the sheet, the thickness of the sheet, and the image density in the curl correcting apparatus.

However, in the case when the driving power of the motor is transmitted to the first curl correcting portion or the second curl correcting portion through the clutch mechanism, the driving power is not transmitted to one curl correcting portion when the driving power is transmitted to the other curl correcting portion. In this case, the cam member adjusting the intrusion amount of the roller of the curl correcting portion is put into a non-holding condition.

Then if the reaction force to the pressing force of the roller and a disturbance such as vibrations from the image forming apparatus, the sheet conveying apparatus, and the sheet processing apparatus are applied to the cam member in this condition, there is a case when the position of the cam member fluctuates and in such a case, it is unable to accurately adjust the intrusion amount of the roller pair. It is noted that the conventional image forming apparatus includes a sheet conveying apparatus having a plurality of roller pairs besides the sheet conveying apparatus conveying a sheet on which a toner image has been fixed to the sheet processing apparatus. Then, there is such roller pair, provided in the sheet conveying apparatus, configured to adjust a nip pressure by a cam member.

Then, if the reaction force to the pressing force of the roller and a disturbance such as vibrations from the image forming apparatus, the sheet conveying apparatus, and the sheet processing apparatus are applied to the cam member in this condition, there is a case when the position of the cam member fluctuates and in such a case, it is unable to accurately adjust the intrusion amount of the roller pair. It is noted that the conventional image forming apparatus includes a sheet conveying apparatus having a plurality of roller pairs beside the sheet conveying apparatus conveying a sheet on which a toner image has been fixed to the sheet processing apparatus. Then, there is such roller pair, provided in the sheet conveying apparatus, configured to adjust a nip pressure by a cam member.

SUMMARY OF THE INVENTION

The present invention provides a sheet conveying apparatus, and an image forming apparatus, capable of accurately controlling positions of a cam member even in driving the cam member by a driving portion. According to one aspect of the invention, a sheet conveying apparatus includes a rotating body pair, a cam member moving one of the rotating body pair to another one, a driving portion capable of rotating in a first direction and in a second direction opposite to the first direction and turning the cam member, a transmitting portion transmitting driving power of the driving portion to the cam member in response to the rotation, in the first direction, of the driving portion, and a restricting portion restricting the cam member from turning in a direction opposite to a turning direction turned in response to the rotation, in the first direction, of the driving portion.

According to a second aspect of the invention, a sheet conveying apparatus includes a first rotating body pair, a second rotating body pair, a first cam member moving one of the first rotating body pair to another one, a second cam member moving one of the second rotating body pair to another one, a driving portion capable of rotating in a first direction and in a second direction opposite to the first direction and turning the first and second cam members, a first transmitting portion transmitting driving power of the driving portion to the first cam member in response to the rotation, in the first direction, of the driving portion, a second transmitting portion transmitting driving power of the driving portion to the second cam member in response to the rotation, in the second direction, of the driving portion, a first restricting portion restricting the first cam member from turning in a direction opposite to a turning direction turned in response to the rotation, in the first direction, of the driving portion, and a second restricting portion restricting the second cam member from turning in a direction opposite to a turning direction turned in response to the rotation, in the second direction, of the driving portion.

Further features of the present invention will become apparent from the following description of exemplary embodiments with reference to the attached drawings.

DESCRIPTION OF THE EMBODIMENTS

Figure 1:
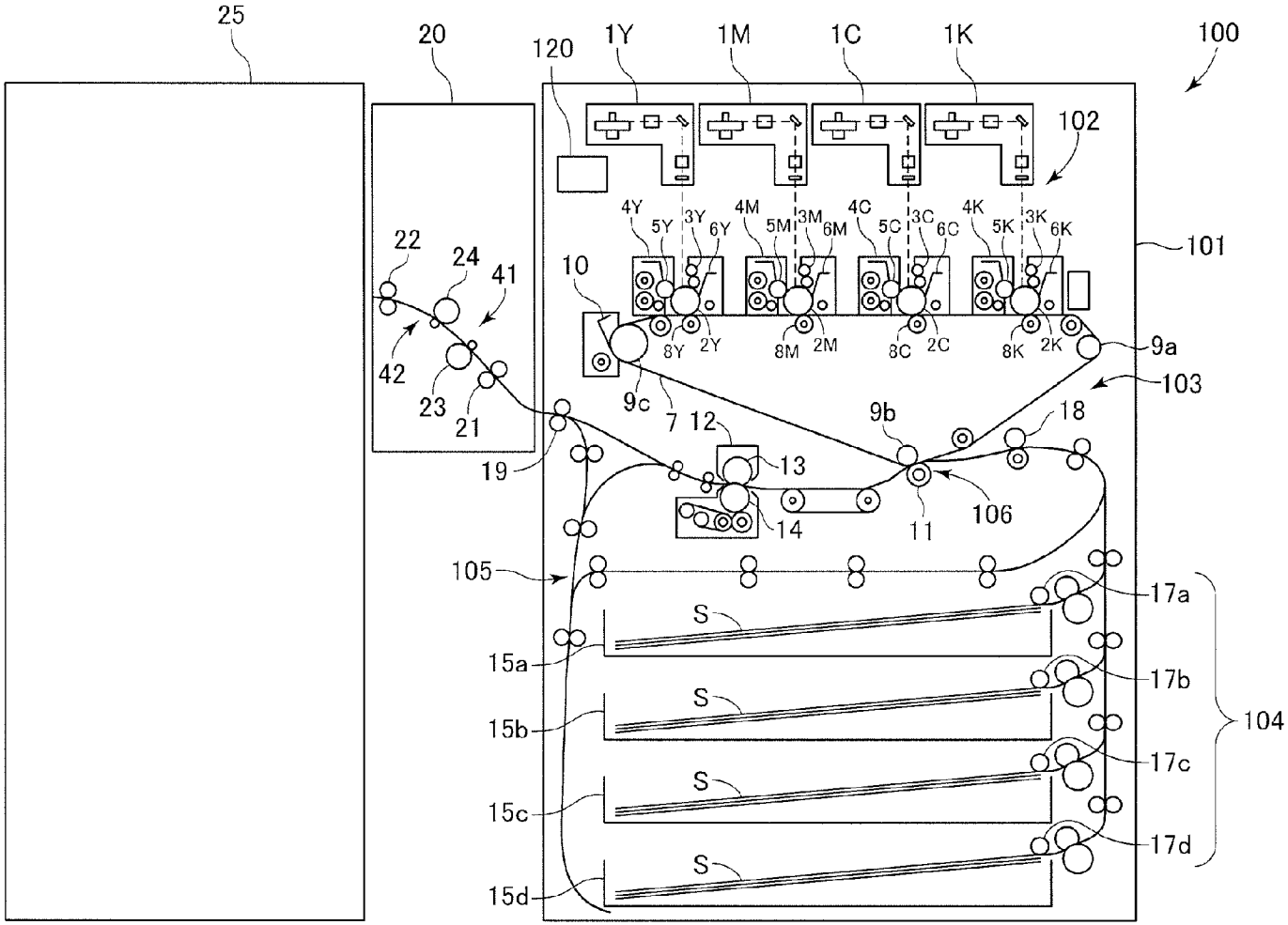
FIG. 1 is a schematic diagram illustrating a configuration of a color laser beam printer of an embodiment.

An embodiment of the present invention will be described in detail below with reference to the drawings. FIG. 1 is a schematic diagram illustrating a configuration of a color laser printer, i.e., one exemplary image forming apparatus, including a sheet conveying apparatus of the embodiment of the invention. In FIG. 1, the color laser printer 100 includes a color laser printer body (referred to simply as a 'printer body' hereinafter) 101. The printer body 101 includes an image forming portion 102 forming an image on a sheet S, an intermediate transfer portion 103, a fixing apparatus 12, and a sheet feeding unit 104 feeding the sheet S to the image forming portion 102.

The image forming portion 102 includes four process stations 4Y, 4M, 4C, and 4K (referred to simply as 'process stations 4Y through 4K' hereinafter) disposed substantially in a horizontal direction and respectively forming four color toner images of yellow (Y), magenta (M), cyan (C), and black (Bk). The image forming portion 102 also includes scanner units 1Y through 1K.

Here, the process stations 4Y through 4K include photosensitive drums 2Y through 2K, i.e., image bearing members, respectively bearing the toner images of four colors of yellow, magenta, cyan, and black and driven by a stepping motor not shown. The process stations 4Y through 4K also include charging rollers 3Y through 3K, developing portions 5Y through 5K, and cleaner portions 6Y through 6K cleaning the photosensitive drums 2Y through 2K. Then, these charging rollers 3Y through 3K, the developing portions 5Y through 5K, the cleaner portions 6Y through 6K, and others are disposed respectively around the photosensitive drums 2Y through 2K in a rotation direction thereof.

The sheet feeding unit 104 is provided at a lower part of the printer body and includes sheet feed cassettes 15*a* through 15*d*, i.e., sheet storing portions storing sheets, and pickup rollers 17*a* through 17*d* delivering the sheet S stacked and stored in the sheet feed cassettes 15*a* through 15*d*.

The intermediate transfer portion 103 includes an intermediate transfer belt 7 rotationally driven in a direction indicated by an arrow in which the respective process stations 4Y through 4K are arrayed in synchronism with an outer circumferential speed of the photosensitive drums 2Y through 2K. Here, the intermediate transfer belt 7 is stretched by a driving roller 9*a*, a secondary transfer inner roller 9*b*, and a tension roller 9*c* that applies an adequate tension to the intermediate transfer belt 7 by a bias force of a spring not shown.

Four primary transfer rollers 8Y through 8K nipping the intermediate transfer belt 7 together with the photosensitive drums 2Y through 2K and composing primary transfer portions are disposed inside the intermediate transfer belt 7. It is noted that these primary transfer rollers 8Y through 8K are connected to a transfer bias power supply not shown. Still further, a secondary transfer outer roller 11 is disposed to face the secondary transfer inner roller 9*b*. The secondary transfer outer roller 11 is in contact with a lowermost surface of the intermediate transfer belt 7 and nips and conveys the sheet S which has been conveyed thereto by a registration roller pair 18 together with the intermediate transfer belt 7. The fixing apparatus 12 fixes a toner image formed onto the sheet S through the intermediate transfer belt 7 to the sheet S and includes a fixing roller 13 and a pressure roller 14.

This color laser printer 100 is configured to be able to form an image on a back surface of the sheet and to that end, is provided with a re-conveying portion 105 reversing the sheet S on a surface (one face) of which the image has been formed and conveying again to the image forming portion 102. A sheet processing apparatus 25 conducting such processes as sorting, stapling and punching on the sheet is connected with a side part of the printer body 101. It is noted that as shown in FIG. 1, the color laser printer 100 includes a control portion 120 controlling the sheet feeding operation of the sheet feeding unit 104, the processing operation of the sheet processing apparatus 25, and a curl correction operation of a curl correcting apparatus 20 described later.

Next, an image forming operation of the color laser printer 100 constructed as described above will be described. At first, in response to an input of an image signal from a personal computer or the like not shown to the scanner units 1Y through 1K, the scanner units 1Y through and 1K irradiate laser beams corresponding to the image signal to the respective photosensitive drums 2Y through 2K. At this time, surfaces of the photosensitive drums 2Y through 2*k* are charged homogeneously with a predetermined polarity and potential in advance by the charging rollers 3Y through 3K, and electrostatic latent images are formed by the laser beams irradiated from the scanner units 1Y through 1K.

Subsequently, the electrostatic latent images are developed respectively by the developing portions 5Y through 5K, and toner images of four colors of yellow, magenta, cyan, and black are formed on the surfaces of the photosensitive drums of the respective process stations 4Y through 4K. Then, the four color toner images are sequentially transferred onto the intermediate transfer belt 7 by primary transfer bias applied to the primary transfer rollers 8 to form a full-color toner image on the intermediate transfer belt 7. After the transfer of the toner images, toner left on the surface of the photosensitive drums is removed by the cleaner portions 6Y through 6K.

In parallel with this toner image forming operation, the sheet S stored in the sheet feed cassette 15 is picked up by the pickup roller 17 and is conveyed to the registration roller pair 18 to correct a skew. Then, by being synchronized with the toner image formed on the intermediate transfer belt 7 by the registration roller pair 18, the sheet S is conveyed to a secondary transfer portion 106 composed of the secondary transfer inner roller 9*b* and the secondary transfer outer roller 11. Then, the full-color toner image on the intermediate transfer belt 7 is secondarily transferred onto the sheet S conveyed to the secondary transfer portion 106 by a positive bias applied to the secondary transfer outer roller 11. It is noted that toner left on the intermediate transfer belt 7 is stored in a cleaner container 10.

After the transfer of the toner image, the sheet S is conveyed to the fixing apparatus 12 to fix the toner image on a surface thereof by being heated and pressed by the fixing roller 13 and the pressure roller 14. Then, the sheet S on which the full-color toner image has been fixed is conveyed by a discharge roller pair 19 toward the sheet processing apparatus 25. It is noted that in a case when images are to be formed on both faces of the sheet, the sheet on one face of which the image has been formed is conveyed by a re-conveying portion 105 to the registration roller pair 18. Then, the registration roller pair 18 conveys the sheet S to the secondary transfer portion 106 to transfer a toner image on a second face of the sheet. The sheet S of which the toner image has been transferred on the second face is conveyed to the fixing apparatus 12 to fix the toner image and is then conveyed by the discharge roller pair 19 toward the sheet processing apparatus 25.

Figure 2A:
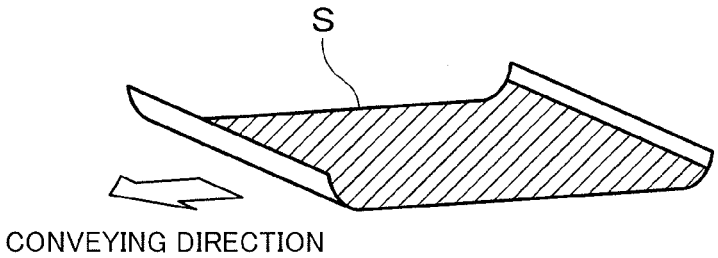
FIG. 2A illustrates a condition in which front and rear end parts of a sheet are curled upward.
Figure 2B:
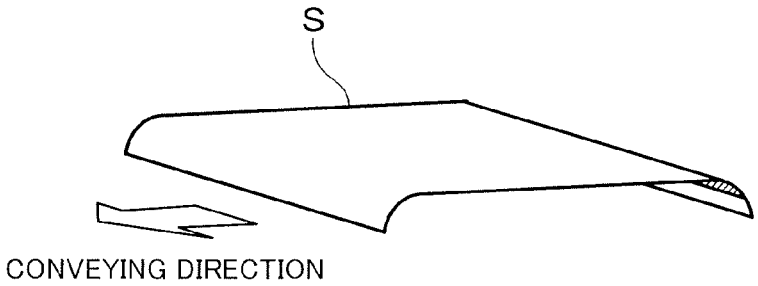
FIG. 2B illustrates a condition in which the front and rear end parts of the sheet are curled downward.

By the way, the sheet S discharged by the discharge roller pair 19 is liable to curl as shown in FIGS. 2A and 2B because a balance of moisture content within the face of the sheet varies due to changes of temperature and humidity and to heating within the fixing apparatus 12 for example. It is noted that this curl may also occur when the sheet is stiffened while being conveyed through the respective conveying paths, the conveying roller nips, the fixing nip, and others. The curl may also occur by differences of cooling speeds, contraction factors and others of the toner, the surface and back face of the sheet when the toner image is heated and fixed.

Then, if the sheet curls, the sheet may cause jamming of the sheet or affect precisions of performances of stacking, aligning, and other processes. Therefore, according to the present embodiment, the curl correcting apparatus 20 is provided between the printer body 101 and the sheet processing apparatus 25. That is, the sheet is conveyed to the sheet processing apparatus 25 after correcting curling of the sheet by the curl correcting apparatus 20, i.e., a sheet conveying apparatus.

Figure 3:
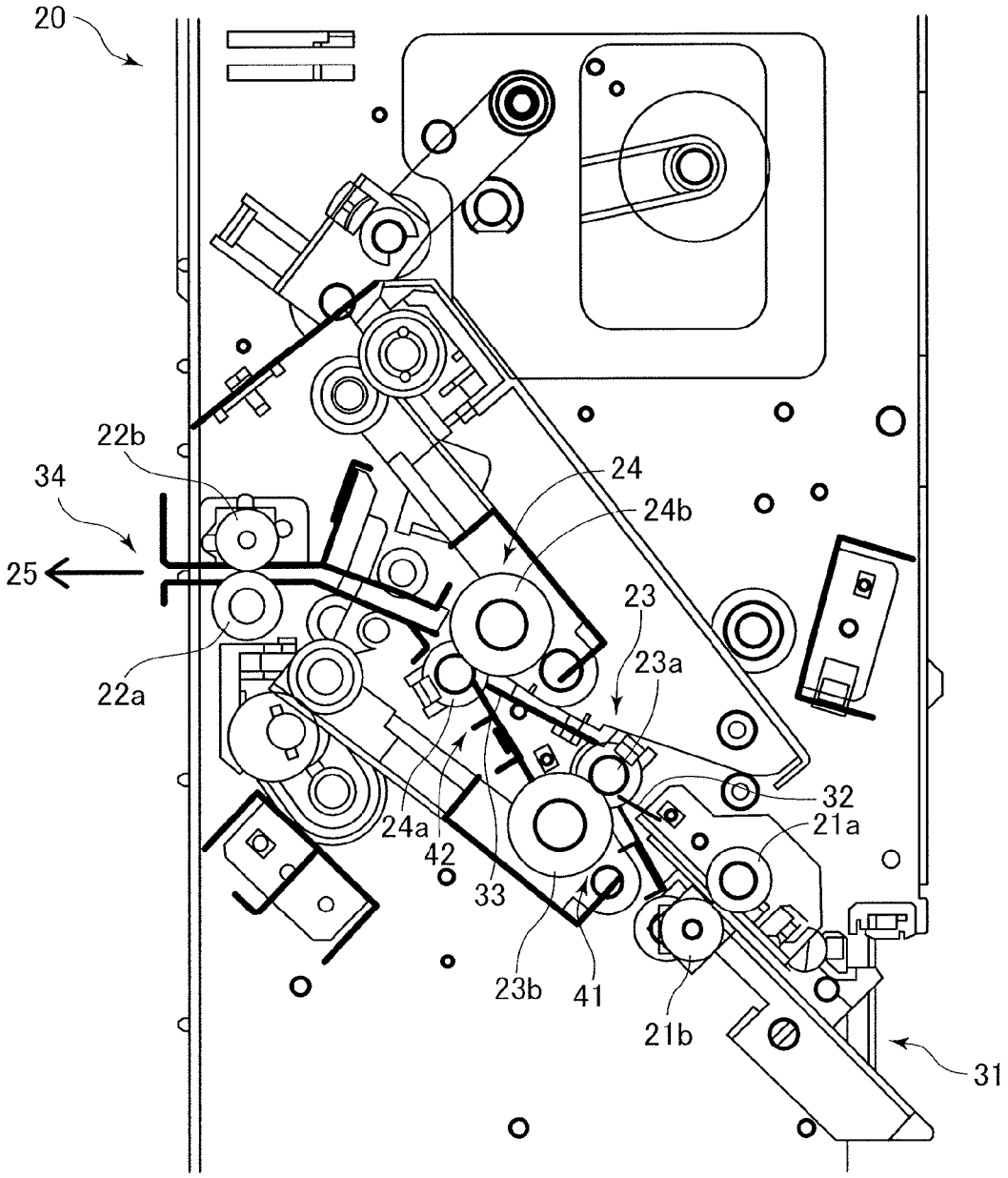
FIG. 3 illustrates a configuration a curl correcting apparatus as a sheet conveying apparatus.

Next, the curl correcting apparatus 20 arranged as described above will be described with reference to FIG. 3. As shown in FIG. 3, the curl correcting apparatus 20 includes an upstream curl correcting portion 41 including an upstream curl correcting roller pair 23, i.e., a first rotating body pair, and a downstream curl correcting portion 42, i.e., a second rotating body pair. It is noted that the upstream curl correcting roller pair 23 is composed of an upstream curl correcting roller (second rotating body) 23*a* formed of a metallic member such as SUS and an upstream driven roller (first rotating body) 23*b* formed of a soft elastic member such as urethane foam.

Still further, the downstream curl correcting roller pair 24 is composed of a downstream curl correcting roller 24*a* rotated by a driving portion not shown and formed of a metallic member such as SUS and a downstream driven roller (third rotating body) 24*b* in pressure contact with the downstream curl correcting roller (fourth rotating body). The upstream and downstream driven rollers 23*b* and 24*b* are in pressure contact with the upstream and downstream curl correcting rollers 23*a* and 24*a*, respectively, while changing an intrusion amount corresponding to a phase of a cam member described later.

As shown in FIG. 3, the curl correcting apparatus 20 also includes an inlet conveyance driving roller 21*a* rotated by a driving portion not shown and formed of an elastic rubber member such as EPDM, an inlet conveyance driven roller 21*b* formed of a plastic member such as POM and is in pressure contact with the inlet conveyance driving roller 21*a* by being biased by a biasing portion not shown, an outlet conveyance driving roller 22*a* rotated by a driving portion not shown and formed of an elastic member such as EPDM, and an outlet conveyance driven roller 22*b* formed of a plastic member such as POM and is in pressure contact with the outlet conveyance driving roller 22*a* by being biased by a biasing portion not shown.

Figure 4:
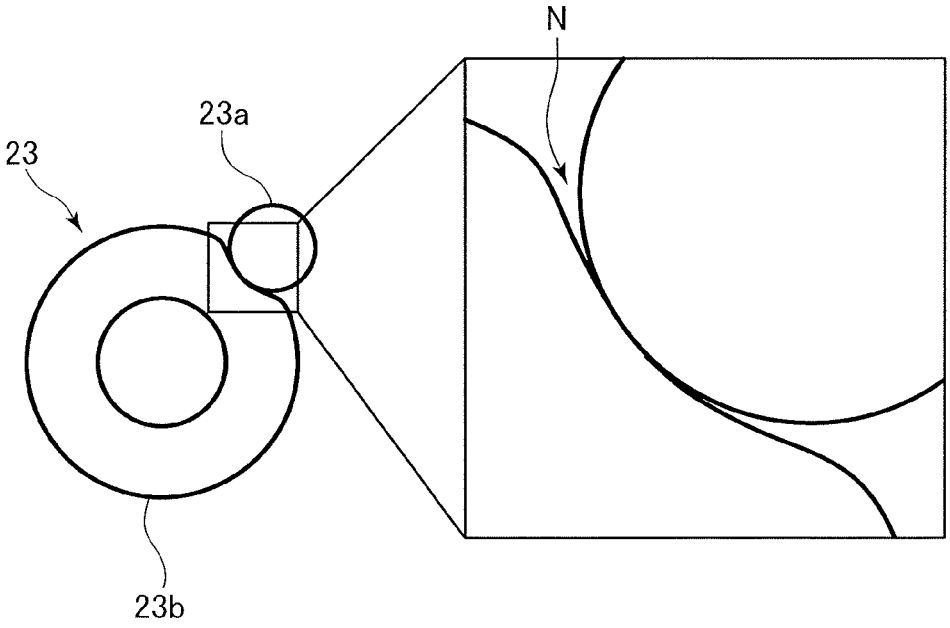
FIG. 4 illustrates a nip portion of an upstream curl correcting roller pair provided in the curl correcting apparatus.

By the way, as shown in FIG. 4, a nip portion N of the upstream curl correcting roller pair 23 is curved by the upstream curl correcting roller 23*a* biting into the upstream driven roller 23*b*. Then, the convex curls of the sheet whose both end parts in the conveying direction are curved upward, i.e., in a first direction, as shown in FIG. 2A can be corrected by the upstream curl correcting roller pair 23 having the nip portion N curved as described above. Still further, the concave curls of the sheet of which the both end parts in the conveying direction are curved downward, i.e., in a second direction opposite to the first direction, can be corrected by the downstream curl correcting roller pair 24.

Here, it is necessary to increase a curvature of the nip portion N in order to increase a curl correcting amount and to that end, it is preferable to use a roller having a diameter smaller than that of other conveying rollers as the upstream curl correcting roller 23*a*. A roller of ϕ8 mm is used in the present embodiment. Still further, the upstream driven roller 23*b* whose hardnesses are different from that of the upstream curl correcting roller 23*a* is preferable to have a large diameter. In the present embodiment, a roller of ϕ24 mm is used. It is noted that the downstream driven roller 24*b* is constructed in the same manner with the downstream curl correcting roller 24*a*.

In the case of assuring the large curvature by using the small-diameter upstream curl correcting roller 23*a* and the large-diameter upstream driven roller 23*b*, a gap between the two rollers 23*a* and 23*b* at an inlet of the nip portion N becomes narrow as compared to those of other conveying rollers. Therefore, the curl correcting apparatus 20 is provided with an upstream conveyance guide portion 32 as shown in FIG. 3 described above in order to convey the sheet S toward a narrow inlet of the nip portion N. It is noted that the curl correcting apparatus 20 is also provided with a downstream conveyance guide portion 33 as shown in FIG. 3 described above in order to convey the sheet S toward an inlet of the downstream curl correcting roller 24*a* and 24*b*.

Then, if the sheet is conveyed from an inlet portion 31 to the curl correcting apparatus 20 constructed as described above, the sheet is guided by the upstream conveyance guide portion 32 to the nip portion of the upstream curl correcting roller pair 23 and the convex curls are corrected. Next, the sheet is guided by the downstream conveyance guide portion 33 to the nip portion of the downstream curl correcting roller pair 24 and the concave curls are corrected. Then, the sheet is passed from an outlet portion 34 to the sheet processing apparatus 25 in a condition in which the curls have been corrected as described above.

Figure 5A:
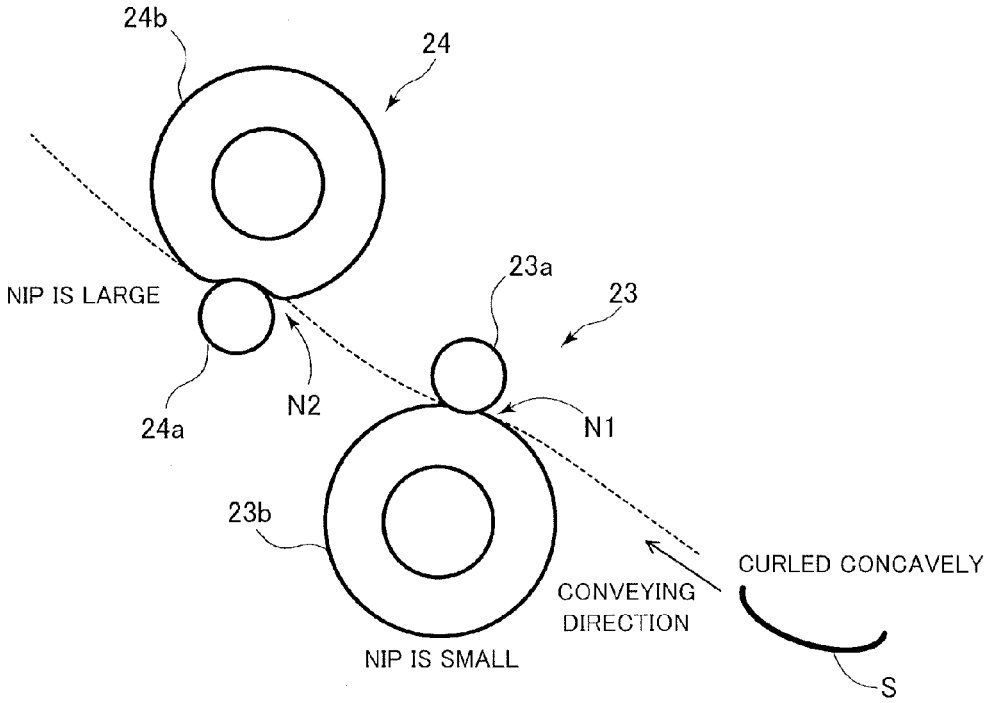
FIG. 5A illustrates a condition in which upstream and downstream curl correcting roller pairs provided in the curl correcting apparatus correct a concave curl.
Figure 5B:
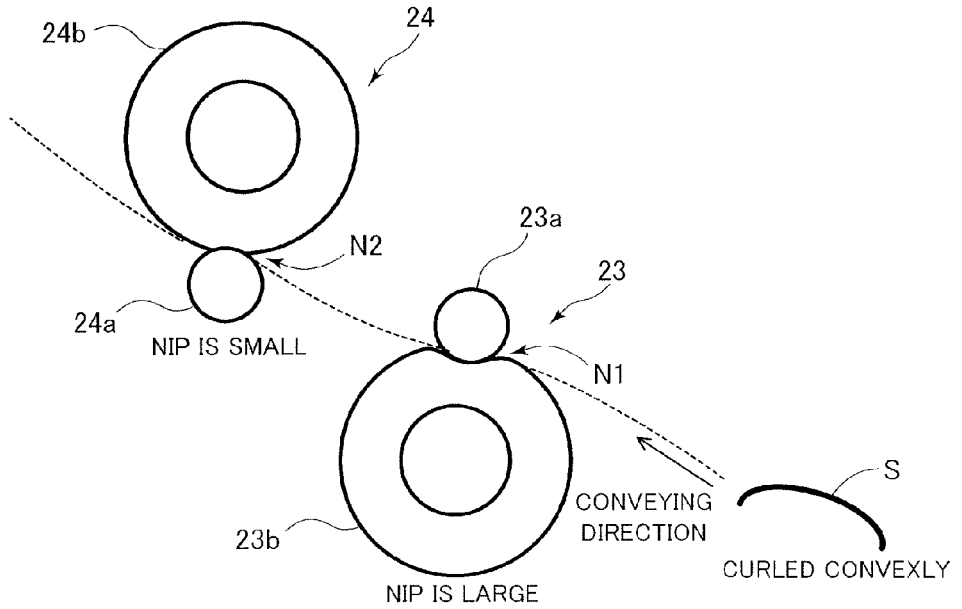
FIG. 5B illustrates a condition in which the upstream and downstream curl correcting roller pairs provided in the curl correcting apparatus correct a convex curl.

It is noted that according to the present embodiment, the curvature of the nip portion N1 of the upstream curl correcting roller pair 23 is increased and the curvature of the nip portion N2 of the downstream curl correcting roller pair 24 is decreased in correcting the convex curls as shown in FIG. 5B. Still further, the curvature of the nip portion N1 of the upstream curl correcting roller pair 23 is decreased and the curvature of the nip portion N2 of the downstream curl correcting roller pair 24 is increased in correcting the concave curls as shown in FIG. 5A.

By the way, because a curling amount varies depending on the various parameters such as the temperature and humidity, the moisture content of the sheet, the type of the sheet, the thickness of the sheet, the image density, the toner quantity, and others, the curl correcting amount is determined corresponding to the respective parameters. Then, based on the determined correcting amount, the control portion 120 changes an intrusion amount (pressing force) of the driven rollers 23*b* and 24*b* against the curl correcting rollers 23*a* and 24*a*. In other words, the control portion 120 changes the shape of the nip portion by a turning amount of a cam member described later.

Next, a curl correcting mechanism portion changing the intrusion amount (pressing force) of the driven rollers 23*b* and 24*b* to the curl correcting rollers 23*a* and 24*a* will be described with reference to FIG. 6. It is noted that while FIG. 6 illustrates the curl correcting mechanism portion of the upstream curl correcting portion 41, a curl correcting mechanism portion of the downstream curl correcting portion 42 is also constructed in the same manner.

Figure 6:
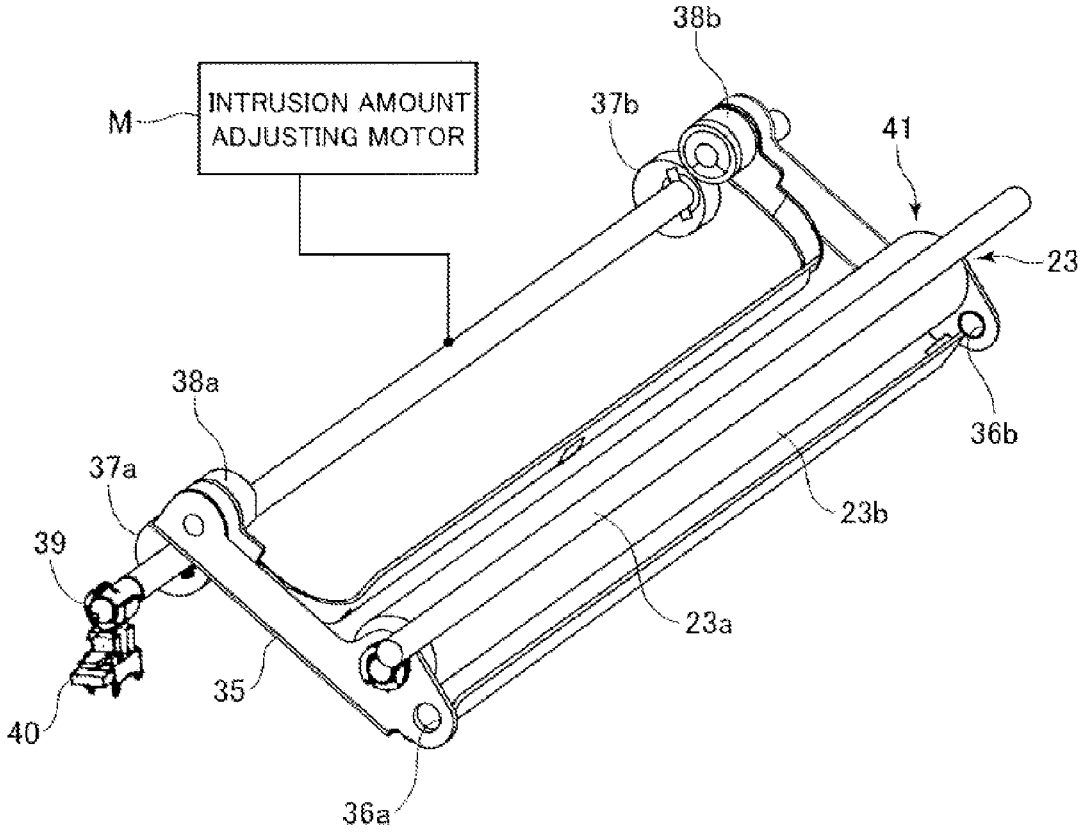
FIG. 6 illustrates a configuration of a curl correcting mechanism portion provided in the curl correcting apparatus.

As shown in FIG. 6, the curl correcting mechanism portion of the upstream curl correcting portion 41 includes a swing member 35 turnably holding the upstream driven roller 23*b*. The swing member 35 swings centering on centers of swing 36 (36*a* and 36*b*) as a fulcrum and is provided with rotatable roller members 38 (38*a* and 38*b*) at swing ends thereof. Being in pressure contact with the roller member 38 is a cam member 37 (37*a* and 37*b*) turned by being driven by an intrusion adjusting motor M, i.e., a driving portion, normally and reversely rotatable (capable of rotating in a first direction and in a second direction opposite to the first direction) and having a cam face of which a height of an outer circumferential surface thereof from a center of rotation gradually changes. It is noted that as shown in FIG. 6, the curl correcting mechanism portion includes a HP detecting flag 39 of the cam member 37 and a photo sensor 40 detecting a home position (HP) of the cam member 37.

Figure 7:
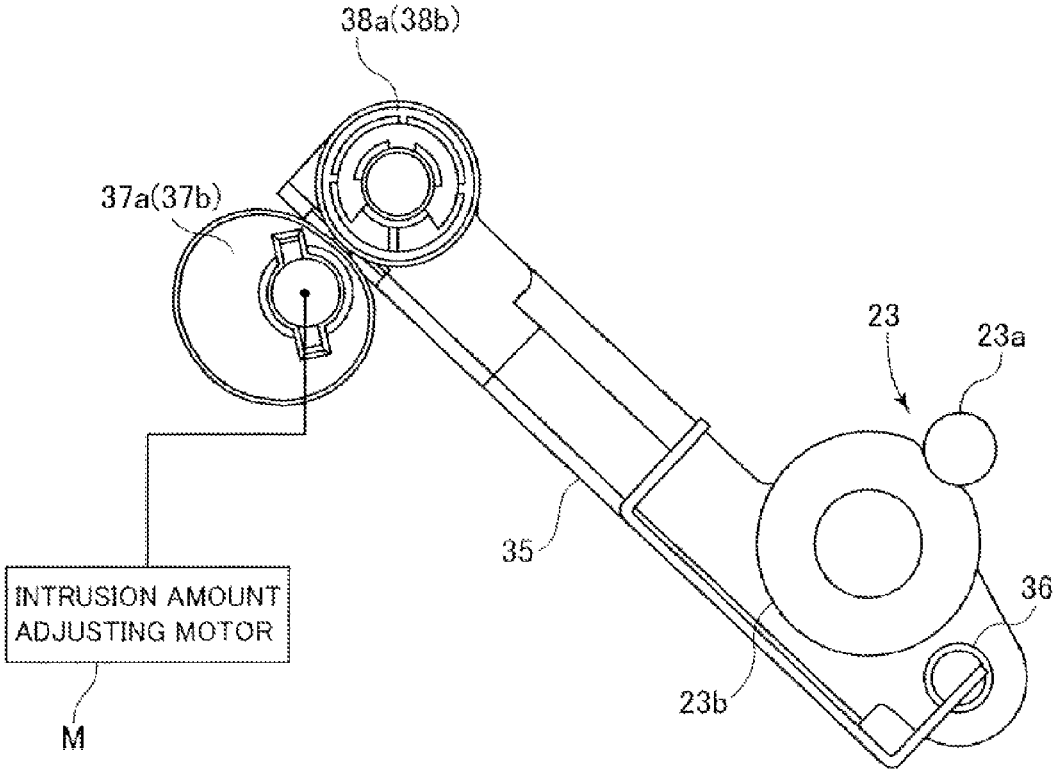
FIG. 7 illustrates a condition before operating the curl correcting mechanism portion.

Here, as shown in FIG. 7, the roller member 38 held by the swing member 35 is always in contact with the outer circumferential surface of the cam member 37 by being pressed by a reaction force of the upstream driven roller 23*b* in pressure contact with the upstream curl correcting roller 23*a* or by a pressing member not shown. Then, if a power supply of the printer body 101 is turned ON for example, the control portion 120 drives the intrusion adjusting motor M and turns the cam member 37 so as to adjust the intrusion amount (pressing force) of the upstream driven roller 23*b* to the upstream curl correcting roller 23*a* corresponding to the curl correcting amount.

It is noted that the control portion 120 determines turning angles from reference angles of the cam members 37*a* and 37*b* corresponding to the curl correcting amount in turning the cam member 37. Then, after detecting that the cam members 37*a* and 37*b* are located at the home position based on signals from the photo sensor 40, the control portion 120 drives the intrusion adjusting motor M to turn the cam members 37*a* and 37*b* by a predetermined degree and adjusts the intrusion amount (pressing force) of the upstream curl correcting roller pair 23 in a plurality of stages. That is, the cam members 37*a* and 37*b* adjust a nip pressure of the upstream curl correcting roller pair 23 by moving one of the upstream curl correcting roller pair 23 to the other one. It is noted that cam members 37*c* and 37*d* also adjust a nip pressure of the downstream curl correcting roller pair 24 by moving one of the downstream curl correcting roller pair 24 to the other one.

Figure 8:
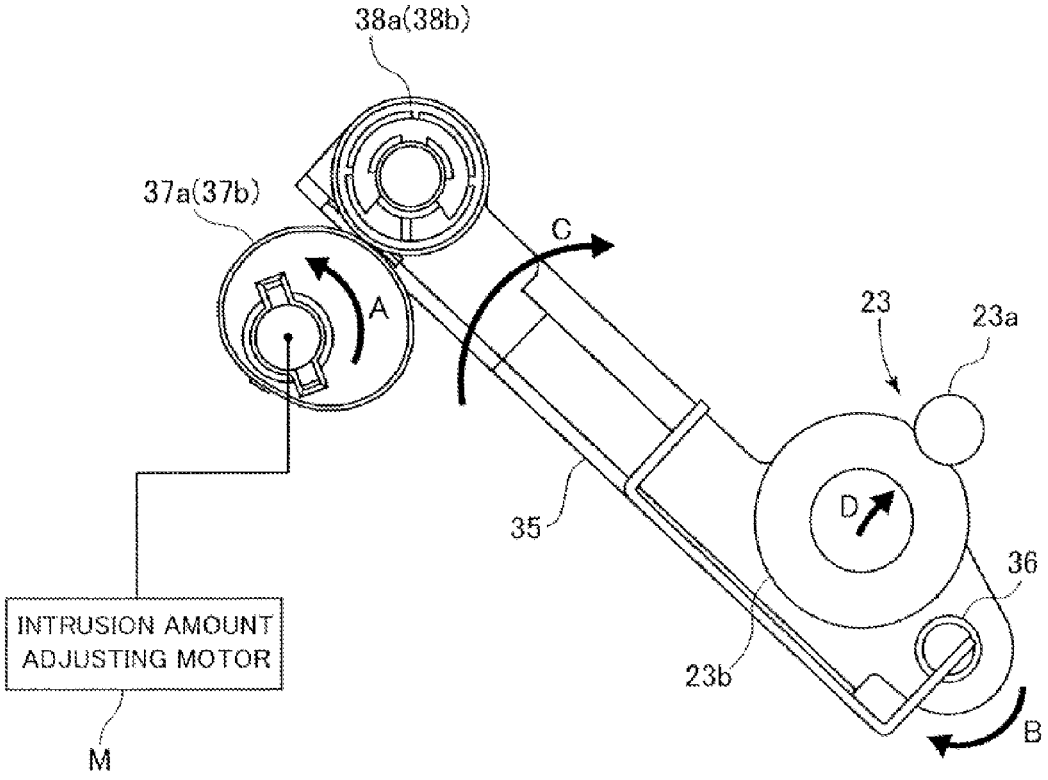
FIG. 8 illustrates a condition in starting to operate the curl correcting mechanism portion.

Here, if the intrusion adjusting motor M is driven and the cam members 37*a* and 37*b* are turned in a direction of an arrow A as shown in FIG. 8 for example, the swing member 35 swings in directions of arrows B and C centering on the swing center portion 36 through the roller members 38*a* and 38*b* and along with that, the upstream driven roller 23*b* moves in a direction of an arrow D. Thereby, the upstream driven roller 23*b* comes into pressure contact with the upstream curl correcting roller 23*a*, and the upstream driven roller 23*b* intrudes into the upstream driven roller 23*b* by a predetermined amount.

Figure 9:
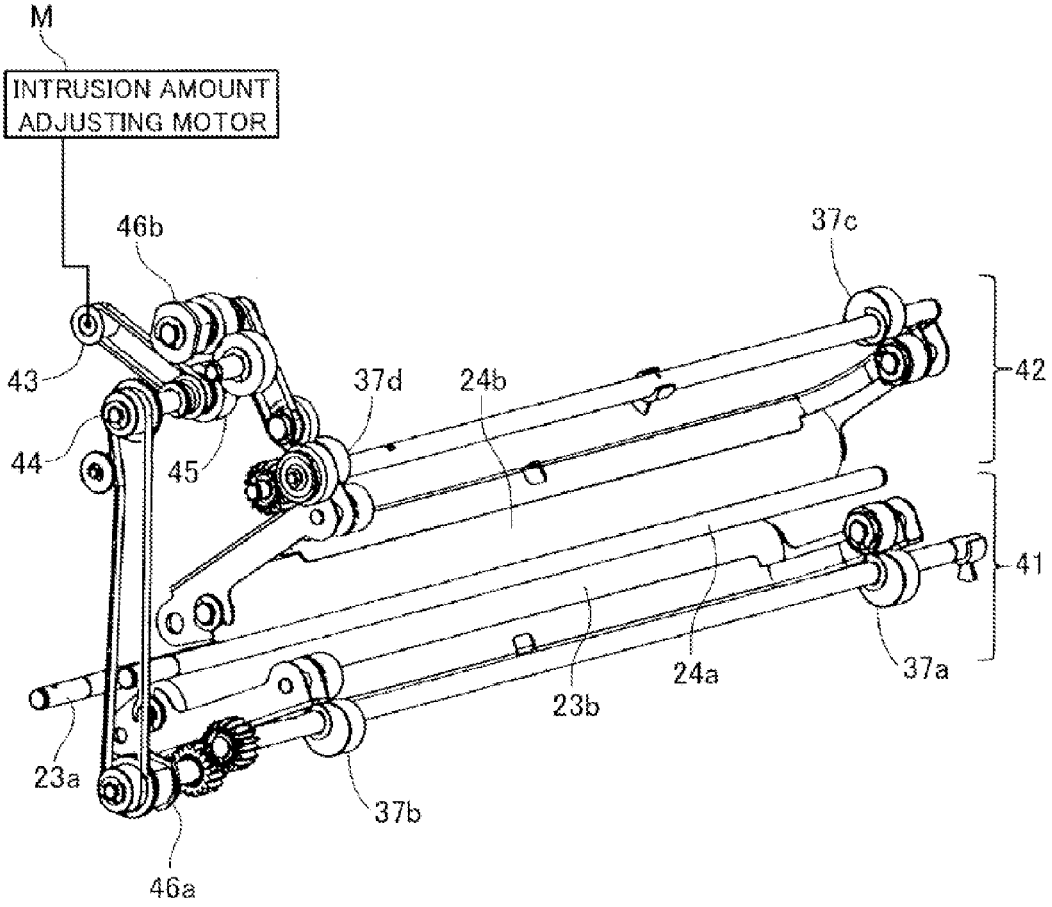
FIG. 9 illustrates a driving mechanism provided in the curl correcting apparatus.

Next, a driving mechanism of the curl correcting apparatus 20 of the present embodiment will be described with reference to FIG. 9. As shown in FIG. 9, the driving mechanism includes an intrusion adjusting motor gear 43, an upstream one-way pulley 44 into which one-way clutch is press-fitted, and a downstream one-way gear 45. The upstream one-way pulley 44 is provided on a transmission path between the intrusion adjusting motor M and the cam members 37*a* and 37*b*, and the downstream one-way gear 45 is also provided on the turning transmission path between the intrusion adjusting motor M and the cam members 37*a* and 37*b*. The driving mechanism also includes upstream and downstream one-way bearings 46*a* and 46*b*. The one-way bearings 46*a* and 46*b* are provided on turning transmission paths between the cam members 37*a* and 37*b* and a fixed frame F1 shown in FIG. 12 described later of the curl correcting apparatus 20. In other words, the one-way bearing 46*a* is provided on the turning transmission path between the upstream one-way pulley 44 and the cam members 37*a* and 37*b*, and the downstream one-way bearing 46*b* is provided on the turning transmission path between the downstream one-way gear 45 and the cam members 37*c* and 37*d*. It is noted that the abovementioned member is "provided on the turning transmission path" means that the member is provided so as to be able to influence on the transmission of the turning transmission path on which the member is provided and the member is operable so long as it is connected to the turning transmission path.

The driving power inputted from the intrusion adjusting motor M is transmitted to the respective driving portions through the intrusion adjusting motor gear 43. That is, when the intrusion adjusting motor M rotates to one side, e.g., normally, i.e., rotates in the first direction, the normal driving power of the intrusion adjusting motor M is transmitted to the cam members (first cam members) 37*a* and 37*b* through the upstream one-way pulley 44, i.e., a first transmitting portion. Still further, when the intrusion adjusting motor M rotates to another side, e.g., reversely i.e., rotates in the second direction, the reverse driving power of the intrusion adjusting motor M is transmitted to the cam members (second cam members) 37*c* and 37*d* through the downstream one-way gear 45, i.e., a second transmitting portion.

Here, in response to a normal rotation of the intrusion adjusting motor M, the downstream one-way gear 45 rotates idly and the driving power to the downstream curl correcting portion 42 is cut off. In response to a reverse rotation of the intrusion adjusting motor M, the upstream one-way pulley 44 rotates idly and the driving power to the upstream curl correcting portion 41 is cut off. Thus, it is possible to drive the upstream and downstream curl correcting portions 41 and 42 respectively independently by utilizing the normal and reverse rotations of the intrusion adjusting motor M in the present embodiment. That is, in the present embodiment, the cam members 37*a* and 37*b* of the upstream curl correcting portion 41 is a driven portion driven by a rotational force transmitted when the intrusion adjusting motor M, i.e., the driven portion, rotates in the first direction and the cam members 37*c* and 37*d* of the downstream curl correcting portion 42 is a driven portion driven by a rotational force transmitted when the intrusion adjusting motor rotates in the second direction.

By the way, in the case of transmitting the driving power to one of the upstream and downstream curl correcting portions 41 and 42 corresponding to the normal or reverse rotations of the intrusion adjusting motor M, the driving power of the other one of the upstream and downstream curl correcting portions 41 and 42 is cut off if the rotation direction of the intrusion adjusting motor M is changed. Then, if the driving power is cut off, it is unable to hold rotation positions of the cam members 37*a* through 37*d* in the curl correcting portion of the side from which the driving power is cut off. In such a case, there is a possibility that the turning angles of the cam members 37*a* through 37*d* fluctuate due to the reaction force to the pressing force of the curl correcting roller of the driven rollers 23*b* and 24*b* and to the disturbance such as vibrations.

Here, it is possible to keep the turning angles of the cam members 37*a* through 37*d* by exciting the motor after turnably driving the cam members 37*a* through 37*d* in driving the upstream and downstream curl correcting portions 41 and 42 respectively by different motors. However, it becomes an obstacle for cutting the power, saving the space, and cutting the cost to drive the upstream and downstream curl correcting portion 41 and 42 respectively by the different motors.

According to the present embodiment, the upstream/downstream driven roller 23*b*/24*b* is pressed by the cam member 37 in response to a turn of the cam member 37 by a predetermined angle in adjusting the intrusion amount of the driven rollers 23*b* and 24*b*, and the upstream/downstream curl correcting roller 23*a*/24*b* bites into the upstream/downstream driven roller 23*b*/24*b* as described above. Therefore, even when no power from the intrusion adjusting motor M is transmitted, a predetermined amount of rotational moment in a direction always opposite to the turning direction in adjusting the intrusion amount is generated in the cam member 37 through the swing member 35 and the roller member 38 by an elastic force of the upstream/downstream driven rollers 23*b* /24*b*.

Then, the moment of reverse rotation is received by the fixed frame F1 by engaging the upstream one-way bearing 46*a*, i.e., a first restricting portion, provided on the turning transmission path between the cam members 37*a* and 37*b* and the upstream one-way pulley 44 in the upstream curl correcting portion 41. Still further, the moment of reverse rotation is received by the fixed frame F1 by engaging the downstream one-way bearing 46*b*, i.e., a second restricting portion, provided on the turning transmission path between the cam members 37*a* and 37*b* and the downstream one-way gear 45 in the downstream curl correcting portion 42.

Figure 10:
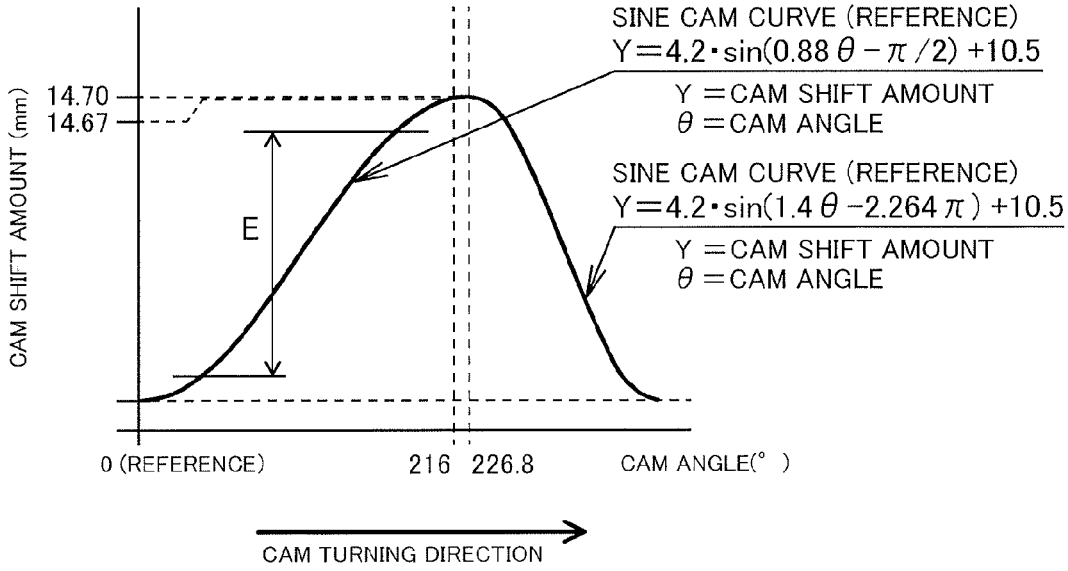
FIG. 10 is a development chart of a cam provided in the curl correcting mechanism portion.

FIG. 10 is a cam development chart of the cam member 37 of the present embodiment. In FIG. 10, 'E' indicates a cam operable range of the cam member 37 corresponding to the intrusion adjusting positions of the driven rollers 23*b* and 24*b*. The cam operable range E is a curve in which a height of the cam member 37 increases in one direction along with an increase of the turning angle from the home position of the cam member 37 in the present embodiment.

Figure 11:
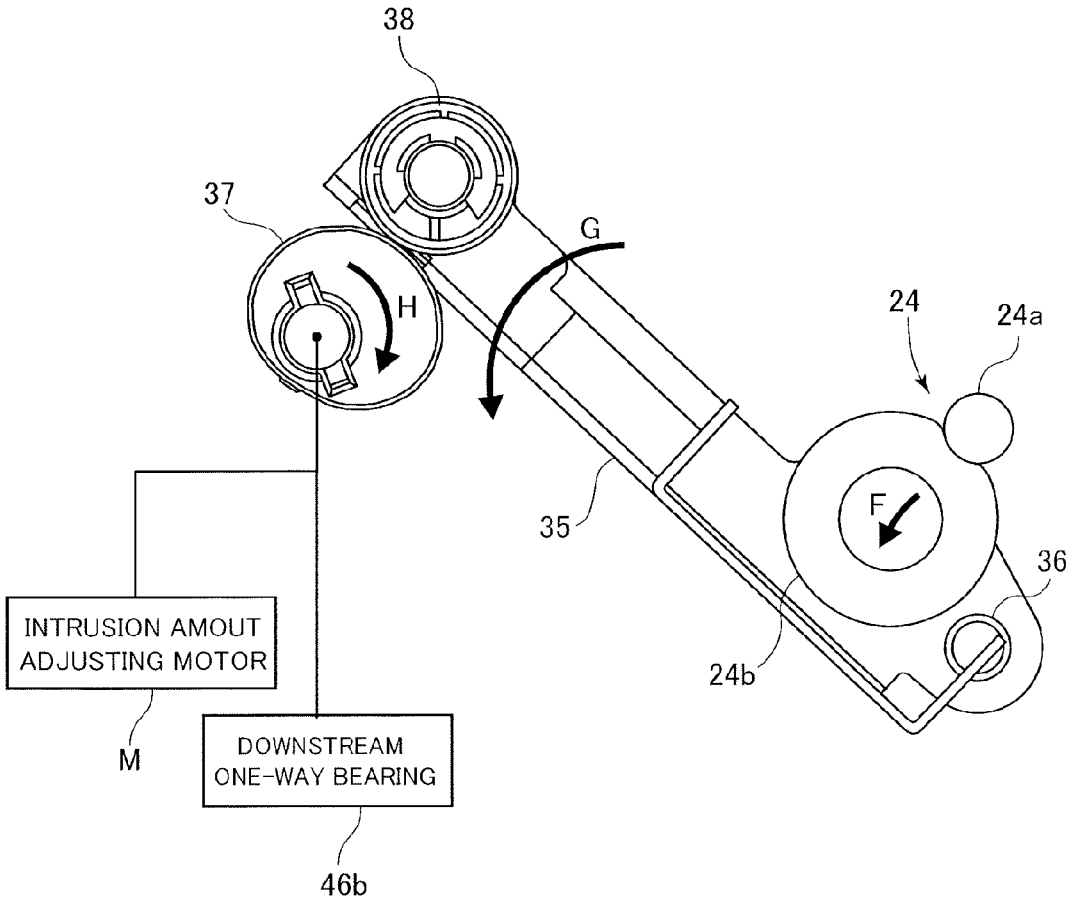
FIG. 11 illustrates an operation of a one-way bearing provided in the driving mechanism.

In a case when the cam operable range E is set as described above and if the intrusion amount is adjusted within the cam operable range E by turning the cam member 37, a rotational moment G is generated in the swing member 35 by a reaction force (elastic force) F of the downstream driven roller 24*b* as shown in FIG. 11. Along with that, a rotational moment H in the opposite direction from that during the adjustment is always generated also in the cam member 37. However, even if such rotational moment H is generated, it is possible to restrict the cam member 37 from turning in a direction opposite to the turning direction turned during the adjustment by receiving the rotational moment H by the fixed frame F1 through the downstream one-way bearing 46*b*. This arrangement makes it possible to keep the turning angle (turning position) of the cam member 37. It is noted that the upstream one-way bearing 46*a* operates similarly to the downstream one-way bearing 46*b*.

Figure 12:
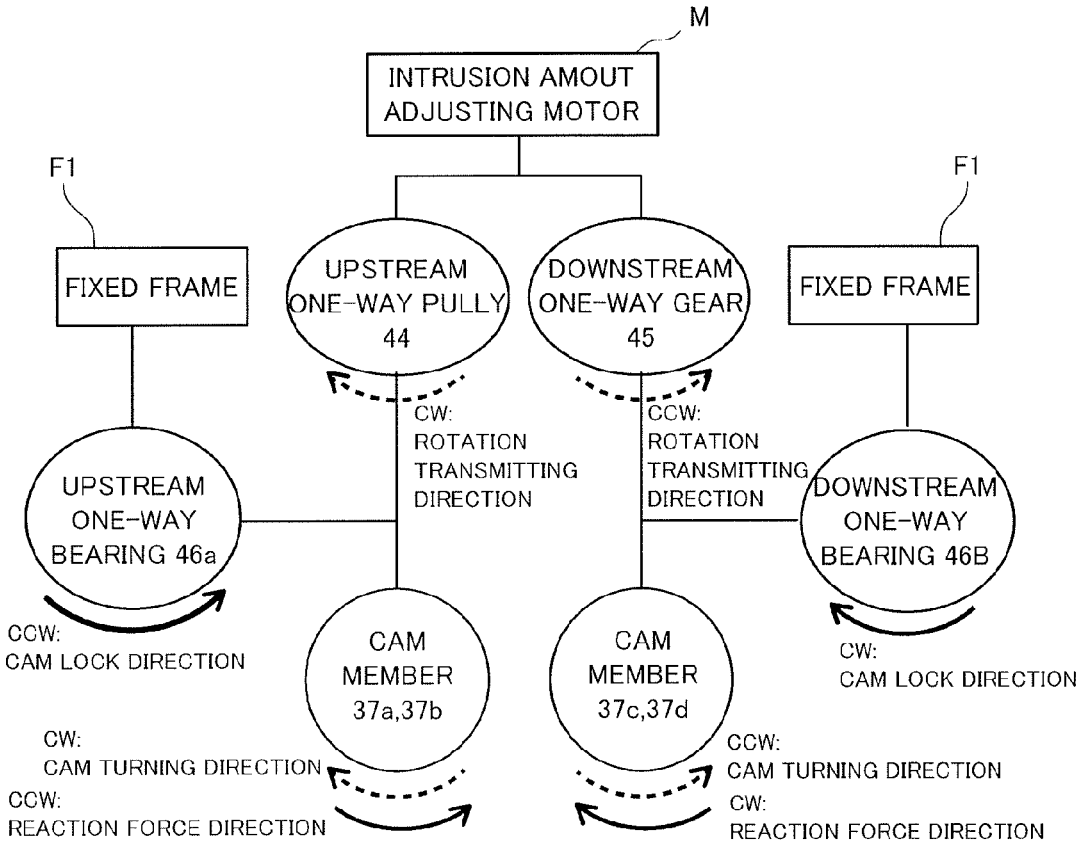
FIG. 12 is a diagram briefly illustrating the driving mechanism.

FIG. 12 is a brief explanatory diagram illustrating a driving structure of the present embodiment. The input from the intrusion adjusting motor M is transmitted to the cam members 37*a* through 37*d* of the upstream and downstream curl correcting portions 41 and 42 through the upstream one-way pulley 44 and the downstream one-way gear 45. It is noted that in the present embodiment, a rotation transmitting direction of the upstream one-way pulley 44 is clockwise (represented simply as 'CW' hereinafter), and a rotation transmitting direction of the downstream one-way gear 45 is counterclockwise (represented simply as 'CCW' hereinafter). Still further, a turning direction of the upstream intrusion adjusting cam members 37*a* and 37*b* turned by the upstream one-way pulley 44 is CW, and a turning direction of the downstream intrusion adjusting cam members 37*c* and 37*d* turned by the downstream one-way gear 45 is CCW.

The abovementioned arrangement makes it possible to receive the rotational reaction force, whose reaction direction is CCW and which the cam members 37*a* and 37*b* receive from the upstream driven roller 23*b*, by the upstream one-way bearing 46*a* fixed to the fixed frame F1 and whose lock direction is CCW, i.e., by the fixed frame F1. Still further, this arrangement makes it possible to receive the rotational reaction force, whose reaction direction is CW and which the cam members 37*c* and 37*d* receive from the downstream driven roller 24*b*, by the downstream one-way bearing 46*b* fixed to the fixed frame F1 and whose lock direction is CW, i.e., by the fixed frame F1.

That is, according to the present embodiment, the fixed frame F1, i.e., a fixed member, receives the rotational reaction force, of which the cam member receives from the driven rollers 23*b* and 24*b*, through the upstream and downstream one-way bearings 46*a* and 46*b*. This arrangement makes it possible to keep the turning angles of the cam members 37*a* through 37*d* even when the rotational moment caused by the reaction force to the pressing force of the driven rollers 23*b* and 24*b*, the disturbances, and others are added to the cam members 37*a* through 37*d* in the condition in which the driving power of the intrusion adjusting motor M is cut off.

As described above, according to the present embodiment, it is possible to keep the turning angles of the cam members 37*a* through 37*d*, turned to the positions where the nip pressures of the curl correcting roller pairs 23 and 24 reach the predetermined magnitude, by receiving the moment of the reverse rotation by the one-way bearings 46*a* and 46*b*. This arrangement also makes it possible to control the positions of the cam members 37*a* through 37*d* accurately also in driving the cam member 37 having a plurality of angle adjustment positions by the intrusion adjusting motor M, i.e., one of the driving portions. As a result, it becomes possible to accurately correct the curls of the sheet and to lower the power, to save the space, and to lower the cost of the curl correcting apparatus 20.

By the way, while the normal and reverse rotations of the intrusion adjusting motor M are transmitted respectively to the upstream and downstream curl correcting portion 41 and 42 in the above description, the present invention is not limited to such configuration. For instance, it is also possible to arrange such that one rotational driving power of the intrusion adjusting motor M is used for the adjustment of position of the curl correcting roller pair, and the other rotary driving power is transmitted to a totally different load or a mechanism. Still further, it is also possible to arrange such that one rotational driving power of the intrusion adjusting motor M is used for the adjustment of the position of the curl correcting roller pair and the other rotary driving power is transmitted so as to turn the curl correcting roller pair whose position is to be adjusted.

Still further, while the upstream one-way pulley 44 and the downstream one-way gear 45 including the one-way clutch have been used as the transmitting portions for transmitting and cutting off the driving power of the normal and reverse rotations of the intrusion adjusting motor M in the description above, the present invention is not also limited to such configuration. For instance, it is also possible to adopt such configurations in which a drive transmission path in normally and reversely rotating the motor is changed by swinging a swing gear, i.e., a transmitting portion, and a drive transmission path is changed by using an actuator such as an electromagnetic clutch, a solenoid, or the like. Still further, while one driving source is used for the two curl correcting roller pairs 23 and 24 in the present embodiment, it is possible to apply the present embodiment and to use a driving source of the registration roller as a power for connecting/disconnecting the secondary transfer nip, or the plurality of conveying roller pairs conveying the sheet may be driven by one motor driving source. Still further, the rotating body may be not the roller described above but may be an endless belt or a film. The rotating body pair may be formed by these endless belt or film or may be formed by combining them with a roller.

Still further, while the upstream and downstream one-way bearings 46*a* and 46*b* have been used as the restricting portions restricting the cam member 37 from turning by receiving the reaction force applied to the cam member 37 when the driving power of the intrusion adjusting motor M is cut off, the present invention is not limited to such configuration. It is also possible to adopt a mechanism using a ratchet mechanism, an electromagnetic clutch, a solenoid, or the like as long as it restricts the turn in one direction. Still further, while the reaction force to the pressing force when the driven roller intrudes has been used as the reaction force applied to the cam member 37 in the opposite direction to the turning direction in adjusting the angle, it maybe also configured such, beside the configuration described above, that the reaction force is generated forcibly by a pressurizing portion such as a spring.

Still further, while the case of passing the sheet S whose curl has been corrected by the curl correcting apparatus 20 to the sheet processing apparatus 25 has been described above, the sheet S may be discharged to a discharge tray not shown in a case where the sheet processing apparatus 25 is not connected. In this case, because the curl of the sheet has been corrected, stackability of the sheet S is improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-208311, filed Oct. 9, 2014, which is hereby incorporated by reference herein in its entirety.

What is claimed is:

1. A sheet conveying apparatus, comprising:

a rotating body pair configured to convey a sheet;

a cam member configured to move one of the rotating body pair with respect to another one of the rotating pair;

a driving portion configured to rotate the cam member in a first direction; and a one-way clutch provided between the cam member and a fixed member and configured to restrict the cam member from rotating in a second direction opposite to the first direction.

2. The sheet conveying apparatus according to claim 1, wherein the cam member adjusts a nip pressure of the rotating body pair, and the rotating body pair is composed of two rollers whose hardness's are different and corrects curls of a sheet in conveying the sheet.

3. The sheet conveying apparatus according to claim 1 wherein the driving portion is configured to rotate in a first driving direction for rotating the cam member in the first direction and configured to rotate in a second driving direction opposite to the first driving direction, the sheet conveying apparatus further comprising a driven portion driven by a rotational force transmitted when the driving portion rotates in the second driving direction.

4. The sheet conveying apparatus according to claim 1, wherein the driving portion is configured to rotate in a first driving direction for rotating the cam member in the first direction and is configured to rotate in a second driving direction opposite to the first driving direction, the sheet conveying apparatus further comprising:

a second one-way clutch configured to transmit a driving force of the driving portion to the cam member in a case that the driving portion rotates in the first driving direction and not to transmit a driving force of the driving portion to the cam member in a case that the driving portion rotates in the second driving direction.

5. The sheet conveying apparatus according to claim 1, wherein the one-way clutch allows rotation of the cam member in the first direction, and restricts rotation of the cam member in the second direction.

6. The sheet conveying apparatus according to claim 1, further comprising:

a second rotating body pair;

a second cam member moving one of the second rotating body pair with respect to another one, wherein the driving portion is configured to rotate in a first driving direction for rotating the cam member in the first direction and is configured to rotate the cam member in the first direction and is capable of rotating in a second driving direction opposite to the first driving direction for rotating the second cam member in a predetermined direction; and a second one-way clutch provided between the second cam member and a fixed member and configured to restrict the second cam member from rotating in a direction opposite to the predetermined direction.

7. The sheet conveying apparatus according to claim 6, further comprising:

a first transmitting portion configured to transmit driving force of the driving portion to the cam member in a case that the driving portion rotates in the first driving direction and not to transmit driving force of the driving portion to the cam member in a case that the driving portion rotates in the second driving direction; and a second transmitting portion configured to transmit driving force of the driving portion to the second cam member in the case that the driving portion rotates in the second driving direction and not to transmit driving force of the driving portion to the second cam member in the case that the driving portion rotates in the first driving direction.

8. A sheet conveying apparatus comprising:

a rotating body pair configured to convey a sheet;

a cam member moving one of the rotating body pair with respect to another one of the rotating pair;

a driving portion configured to rotate in a first driving direction and in a second driving direction opposite to the first driving direction and rotating the cam member;

a first one-way clutch configured to transmit a driving force of the driving portion to the cam member in a case that the driving portion rotates in the first driving direction and not to transmit a driving force of the driving portion to the cam member in a case that the driving portion rotates in the second driving direction; and a second one-way clutch configured to allow rotation of the cam member in a predetermined direction in which the cam member rotates in the case that the driving portion rotates in the first driving direction, and configured to restrict rotation of the cam member in a direction opposite to the predetermined direction.

9. The sheet conveying apparatus according to claim 3 wherein the second one-way clutch is provided between the cam member and a fixed member.

10. A sheet conveying apparatus comprising:

a rotating body pair;

a cam member moving one of the rotating body pair to another one of the rotating body pair;

a driving portion configured to rotate in a first direction and in a second direction opposite to the first direction and turning the cam member;

a transmitting portion transmitting driving power of the driving portion to the cam member in response to a rotation, in the first direction, of the driving portion, to turn the cam in a turning direction; and a restricting portion restricting the cam member from turning in a direction opposite to the turning direction, wherein the restricting portion is provided on a transmission path between the transmitting portion and the cam member.

11. A sheet conveying apparatus, comprising:

a first rotating body pair;

a second rotating body pair a first cam member moving one of the first rotating body pair to another one;

a second cam member moving one of the second rotating body pair to another one;

a driving portion configured to rotate in a first direction and in a second direction opposite to the first direction and turning the first and second cam members;

a first transmitting portion transmitting driving force of the driving portion to the first cam member in response to the rotation, in the first direction, of the driving portion;

a second transmitting portion transmitting driving force of the driving portion to the second cam member in response to the rotation, in the second direction, of the driving portion;

a first restricting portion restricting the first cam member from turning in a direction opposite to a turning direction turned in response to the rotation, in the first direction, of the driving portion; and a second restricting portion restricting the second cam member from turning in a direction opposite to a turning direction turned in response to the rotation, in the second direction, of the driving portion.

12. The sheet conveying apparatus according to claim 11, wherein the first cam member adjusts a nip pressure of the first rotating body pair;

the second cam member adjusts a nip pressure of the second rotating body pair;

the first rotating body pair includes two rollers whose hardnesses are different and corrects curls in a first curl direction of a sheet in conveying the sheet; and the second rotating body pair includes two rollers whose hardnesses are different and corrects curls in a second curl direction, opposite to the first direction, of the sheet in conveying the sheet.

13. The sheet conveying apparatus according to claim 11 wherein the first transmitting portion includes a one-way clutch which transmits driving force of the driving portion to the first cam member in response to the rotation, in the first direction, of the driving portion and rotates idly in response to the rotation, in the second direction, of the driving portion;

wherein the second transmitting portion includes a one-way clutch which transmits driving force of the driving portion to the second cam member in response to the rotation, in the second direction, of the driving portion and rotates idly in response to the rotation, in the first direction, of the driving portion;

wherein the first restricting portion includes a one-way clutch which rotates idly in response to the rotation, in the first direction, of the driving portion, and engages the first cam member with a fixed member by engaging itself when the first cam member turns in a direction opposite to a direction when the driving portion rotates in the first direction; and wherein the second restricting portion includes a one-way clutch which rotates idly in response to the rotation, in the second direction, of the driving portion, and engages the second cam member with a fixed member by engaging itself when the second cam member turns in a direction opposite to a direction when the driving portion rotates in the second direction.

14. The sheet conveying apparatus according to claim 11 wherein the first restricting portion is provided on a transmission path between the first transmitting portion and the first cam member.

15. The sheet conveying apparatus according to claim 11 wherein the second restricting portion is provided on a transmission path between the second transmitting portion and the second cam member.

16. The sheet conveying apparatus according to claim 11 wherein the first restricting portion includes a one-way clutch provided between the first cam member and a fixed member.

17. The sheet conveying apparatus according to claim 11 wherein the second restricting portion includes a one-way clutch provided between the second cam member and a fixed member.

18. An image forming apparatus, comprising:

a rotating body pair;

an image forming portion forming an image on a sheet;

a cam member configured to move one of the rotating body pair with respect to another one of the rotating pair;

a driving portion configured to rotate the cam member in a first direction;

a one-way clutch provided between the cam member and a fixed member and configured to restrict the cam member from rotating in a second direction opposite to the first direction.

* * * * *